US007793511B2

(12) United States Patent
Yoon et al.

(10) Patent No.: US 7,793,511 B2
(45) Date of Patent: Sep. 14, 2010

(54) MULTI TYPE AIR-CONDITIONER AND CONTROL METHOD THEREOF

(75) Inventors: Seok-Ho Yoon, Gyeonggi-Do (KR); Ki-Bum Kim, Seoul (KR); Pil-Hyun Yoon, Seoul (KR); Jin-Ha Choi, Gyeonggi-Do (KR); Balk-Young Chung, Incheon (KR)

(73) Assignee: LG Electronics Inc., Seoul (KR)

( * ) Notice: Subject to any disclaimer, the term of this patent is extended or adjusted under 35 U.S.C. 154(b) by 569 days.

(21) Appl. No.: 11/349,891

(22) Filed: Feb. 9, 2006

(65) Prior Publication Data

US 2006/0179856 A1 Aug. 17, 2006

(30) Foreign Application Priority Data

Feb. 15, 2005 (KR) ..... 10-2005-0012462

(51) Int. Cl.
*F25B 13/00* (2006.01)

(52) U.S. Cl. ..... 62/208; 62/210

(58) Field of Classification Search ..... 62/160, 62/324.1, 324.4, 210; 165/58
See application file for complete search history.

(56) References Cited

U.S. PATENT DOCUMENTS 4,312,188 A * 1/1982 Swenson et al. ..... 62/160
4,760,707 A 8/1988 Dennis et al.
4,771,610 A * 9/1988 Nakashima et al. ..... 62/160
5,303,562 A * 4/1994 Bahel et al. ..... 62/222
6,038,873 A * 3/2000 Koo ..... 62/196.4
6,755,038 B2 6/2004 Hwang
6,772,600 B2 8/2004 Hwang
2001/0003906 A1 * 6/2001 Roh ..... 62/231

(Continued)

FOREIGN PATENT DOCUMENTS

CN 1469084 1/2004

(Continued)

OTHER PUBLICATIONS

McQuiston et al.; Heating, Ventilating, and Air Conditioning Analysis and Design, 6th Edition; Chapter 15, pp. 550-552.*

(Continued)

*Primary Examiner*—Cheryl J Tyler
*Assistant Examiner*—Lakiya Rogers
(74) *Attorney, Agent, or Firm*—Ked & Associates LLP

(57) ABSTRACT

A multi type air-conditioner is provided. The multi type air conditioner includes an outdoor unit having a plurality of outdoor heat exchangers that heat-exchanges with outdoor air and a compressor that compresses a refrigerant; a plurality of indoor units that performs either cooling or heating; a high pressure pipe connected between a discharge side of the compressor and the plurality of indoor units; a low pressure pipe connected between a suction side of the compressor and the plurality of indoor units; and a refrigerant exhauster provided between the high pressure pipe and the low pressure pipe. The refrigerant exhauster discharges a liquid refrigerant to the low pressure pipe when the liquid refrigerant is accumulated in the high pressure pipe, whereby degradation of cooling capability due to a lack of refrigerant may be prevented by minimizing accumulation of the liquid refrigerant in the high pressure pipe in a cooling operation mode.

5 Claims, 5 Drawing Sheets

U.S. PATENT DOCUMENTS

| | | | | |
|---|---|---|---|---|
| 2003/0230100 | A1* | 12/2003 | Hwang, II | 62/184 |
| 2004/0035133 | A1 | 2/2004 | Park et al. | |
| 2004/0134205 | A1* | 7/2004 | Park et al. | 62/151 |

FOREIGN PATENT DOCUMENTS

| | | |
|---|---|---|
| CN | 1517632 | 8/2004 |
| EP | 1394483 | 3/2004 |
| EP | 1437557 | 7/2004 |
| EP | 1526341 | 4/2005 |
| EP | 1643196 | 4/2006 |

OTHER PUBLICATIONS

U.S. Appl. No. 11/354,093 to Yoon et al., filed Feb. 15, 2006.
U.S. Appl. No. 11/194,440 to Kim et al., filed Aug. 2, 2005.
English language Abstract of CN 1469084.

* cited by examiner

MULTI TYPE AIR-CONDITIONER AND CONTROL METHOD THEREOF

BACKGROUND OF THE INVENTION

1. Field of the Invention

The present invention relates to a multi type air-conditioner and a refrigerant control method thereof, and particularly, to a multi type air-conditioner and a control method thereof capable of improving cooling efficiency by preventing a liquid refrigerant from being accumulated in a high pressure pipe.

2. Description of the Conventional Art

In general, a multi type air-conditioner is provided with several indoor units, and accordingly some indoor units thereof perform a heating and the other indoor units thereof perform a cooling.

FIG. 1 shows a construction of a multi type air-conditioner according to the conventional art.

A multi type air-conditioner according to the conventional art includes: an outdoor unit 102 heat-exchanged with outdoor air; a plurality of indoor units 104 heat-exchanged with indoor air, for performing cooling and heating operations; and a distributor 106 provided between the outdoor unit 102 and the indoor units 104, for appropriately distributing a refrigerant of the outdoor unit 102 to the indoor units 104.

The outdoor unit 102 includes: a plurality of outdoor heat exchangers 108 heat-exchanged with outdoor air; a four-way valve 110 for switching a flow of a refrigerant in a forward direction or a reverse direction; an outdoor expansion valve 122 arranged in a refrigerant pipe 120 which is connected between the outdoor heat exchangers 108 and the indoor units 104, for changing the refrigerant into a state of low temperature and low pressure; a compressor 130 for compressing the refrigerant into a state of high temperature and high pressure; and an accumulator 132 connected to a suction side of the compressor 130, for dividing the refrigerant into gas and liquid and then supplying the refrigerant in a gaseous state to the compressor 130.

A blowing fan 134 for blowing outdoor air for heat-exchanging toward the outdoor heat exchangers 108 is installed at one side of the outdoor heat exchangers 108, and a bypass passage 126 having a check valve therein is installed at the refrigerant pipe 120 at which the outdoor expansion valve 122 is installed.

The indoor units 104 respectively includes an indoor heat exchanger 112 heat-exchanged with indoor air, and an indoor expansion valve 114 installed at one side of the indoor heat exchanger 112.

The distributor 106 includes: a high pressure pipe 140 connected to a discharge side of the compressor 130; first distributing pipes 144 diverged from the high pressure pipe 140 to each indoor unit 104; a low pressure pipe 142 connected to a suction side of the compressor 130; second distributing pipes 146 diverged from the low pressure pipe 142 to each indoor unit 104; first valves 150 installed at each of the first distributing pipes 144, for opening and closing the first distributing pipes 144; and second valves 152 installed at each of the second distributing pipes 146, for opening and closing the second distributing pipes 146.

Third distributing pipes 148 are diverged from the refrigerant pipe 120 which is connected to each of the outdoor heat exchangers 108, and thus connected to each of the indoor heat exchangers 112.

An operation of the air-conditioner according to the conventional art having such construction will now be explained. As shown in FIG. 1, if some of the indoor units 104 perform a cooling, and the other indoor units thereof perform a heating, the first valves 150 connected to the indoor heat exchangers 112 in a cooling operation mode are turned off, and the second valves 152 are turned on. Thereafter, the first valves 150 connected to the indoor heat exchangers 112 in a heating operation mode are turned on, and the second valves 152 are turned off.

In such a state, when the compressor 130 is driven, parts of the refrigerant compressed in the compressor 130 are condensed by passing through the outdoor heat exchangers 108 and then flow along the refrigerant pipe 120. Afterwards, the parts of the refrigerant are expanded with a reduced pressure by passing through the indoor expansion valves 114, and suck latent heat from the indoor heat exchangers 112, thereby performing a cooling operation. The parts of the refrigerant having passed through the indoor heat exchangers 112 flow into the compressor 130 through the second distributing pipes 146 and the low pressure pipe 142 because the second valves 152 are turned on and thus the second distributing pipes 146 are in an opened state.

The parts of the refrigerant compressed in the compressor 130 flow into each of the first distributing pipes 144 through the high pressure pipe 140. Accordingly, the first valves 150 are turned on so that the refrigerant is supplied to the indoor heat exchangers 112 through the opened first distributing pipes 144, thereby discharging heat and thus performing a heating operation. The refrigerant having passed through the indoor heat exchangers 112 joins the refrigerant flowing in the refrigerant pipe 120.

On the contrary, when all of the indoor units 104 perform the cooling operation, as shown in FIG. 2, the first valves 150 are turned off, and the second valves 152 are turned on. When the compressor 130 is driven in this state, the refrigerant compressed in the compressor 130 is condensed by passing through the outdoor heat exchangers 108, and then supplied to each indoor unit 104 through the refrigerant pipe 120 and each of the third distributing pipes 148. The refrigerant supplied to each indoor unit 104 is expanded with a reduced pressure by passing through the indoor expansion valve 114, so as to be supplied to the indoor heat exchangers 112. The refrigerant is heat-exchanged with indoor air while passing through the indoor heat exchanger 112, thereby performing the cooling operation. The refrigerant having passed through the indoor heat exchanger 112 flows into the compressor 130 through the opened second distributing pipes 146 and the low pressure pipe 142 as the second valves 152 are turned on.

However, in the air-conditioner according to the conventional art having such construction, when all of the indoor units 104 perform the cooling operation, because the first valve 150 is turned off and thus the high pressure pipe 140 is closed, parts of the refrigerant of high temperature and high pressure which has been compressed in the compressor 130 fill the inside of the high pressure pipe 140. Accordingly, the refrigerant is condensed in the high pressure pipe 140, and thereby a liquid refrigerant is accumulated in the high pressure pipe 140, which causes a lack of the refrigerant which should be circulated. As a result, the cooling capability is degraded.

In particular, if the high pressure pipe 140 is lengthened because of the distance between the indoor unit 104 and the distributor 106, a considerable amount of liquid refrigerant is accumulated in the high pressure pipe 140 and accordingly the refrigerant which should be circulated is insufficient, which results in damages by a fire on the compressor due to a lack of oil.

SUMMARY OF THE INVENTION

Therefore, to solve those shortcomings of the conventional art, an object of the present invention is to provide a multi type air-conditioner and a control method thereof capable of preventing cooling capability from being degraded due to a lack of refrigerant by minimizing a refrigerant amount accumulated in a high pressure pipe at the time of a cooling operation.

To achieve these and other advantages and in accordance with the purpose of the present invention, as embodied and broadly described herein, there is provided a multi type air-conditioner comprising: an outdoor unit having outdoor heat exchangers heat-exchanged with outdoor air and a compressor for compressing a refrigerant; indoor units for performing either cooling or heating; a high pressure pipe connected between a discharge side of the compressor and the indoor units; a low pressure pipe connected between a suction side of the compressor and the indoor units; and a refrigerant exhauster provided between the high pressure pipe and the low pressure pipe, for discharging a liquid refrigerant to the low pressure pipe when the liquid refrigerant is accumulated in the high pressure pipe.

The refrigerant exhauster includes: a connection tube connected between the high pressure pipe and the low pressure pipe; an open and shut valve installed at the connection tube, for opening/closing the connection tube; and a capillary tube installed at the connection tube.

The refrigerant exhauster further comprises: a first temperature sensor installed at the discharge side of the compressor, for detecting a temperature of the discharge side of the compressor; and a second temperature sensor installed at the high pressure pipe, for detecting a temperature of the high pressure pipe.

To achieve these and other advantages and in accordance with the purpose of the present invention, as embodied and broadly described herein, there is provided a control method of a multi type air-conditioner comprising: deciding whether all indoor units in operation perform a cooling; comparing a temperature of a discharge side of a compressor with a temperature of a high pressure pipe when it is decided in the decision step that all the indoor units perform the cooling; and turning an open and shut valve on to open a connection tube connected between a high pressure pipe and a low pressure pipe when it is decided in the decision step that a temperature difference therebetween is more than a set value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

There may exist a plurality of embodiments of a multi type air-conditioner according to the present invention, and the preferred embodiments therefor will now be explained.

Figure 1:
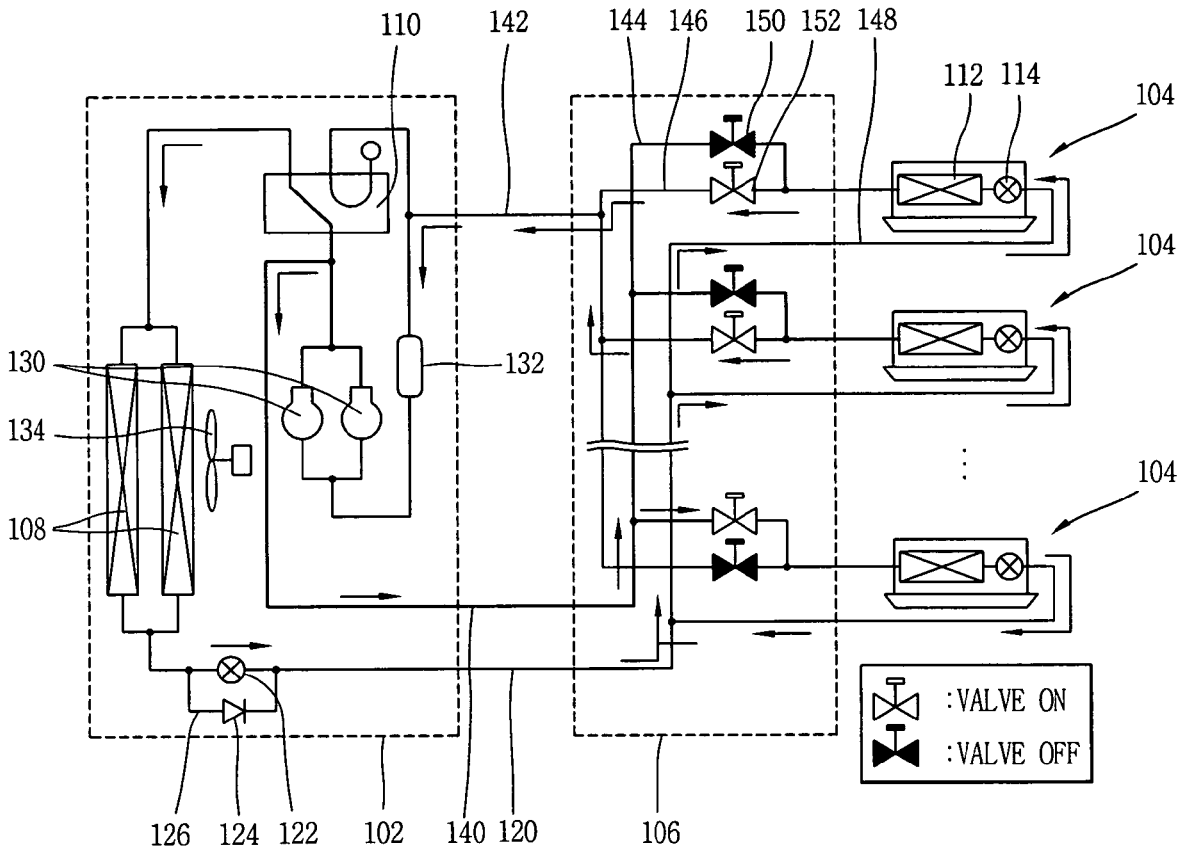
FIG. 1 is a diagram showing a construction of a multi type air-conditioner according to the conventional art.
Figure 2:
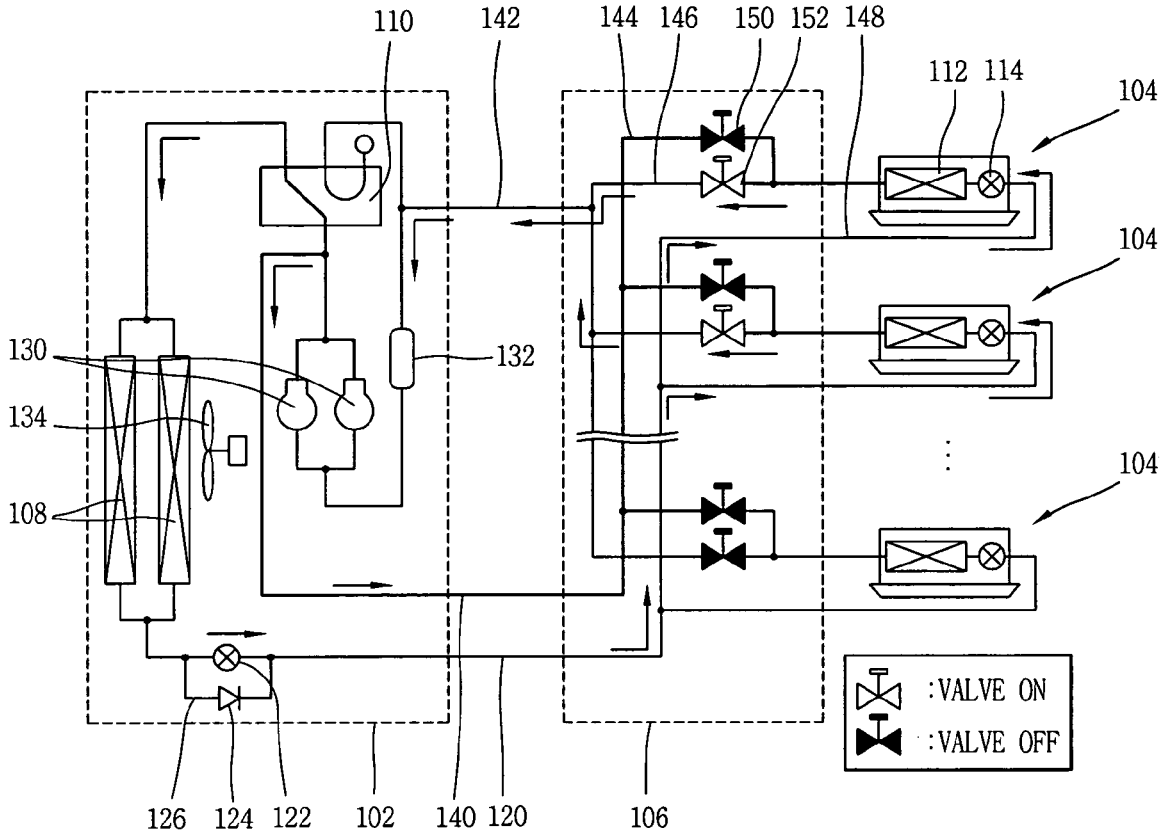
FIG. 2 is a diagram showing an operational state of the multi type air-conditioner according to the conventional art.
Figure 3:
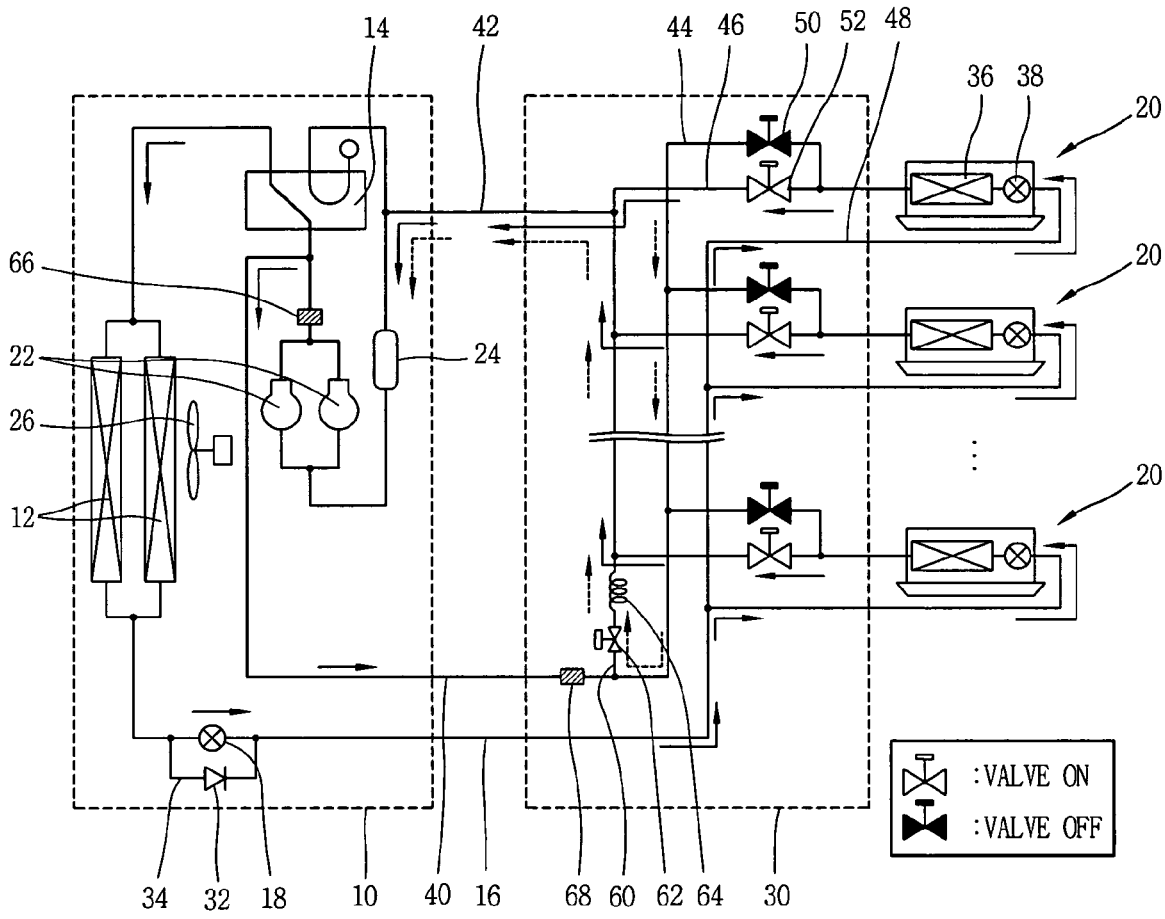
FIG. 3 is a diagram showing a construction of a multi type air-conditioner according to the present invention.

FIG. 3 is a diagram showing a construction of a multi type air-conditioner according to the present invention.

A multi type air-conditioner according to the present invention includes: an outdoor unit 10 arranged outdoors and heat-exchanged with outdoor air; a plurality of indoor units 20 arranged indoors and performing cooling and heating of inside areas; and a distributor 30 installed between the outdoor unit 10 and the indoor units 20, for distributing a refrigerant discharged from the outdoor unit 10 to each of the indoor units 20.

The outdoor unit 10 includes: a plurality of heat exchangers 12 heat-exchanged with outdoor air; a four-way valve 14 for switching a flow of the refrigerant in a forward direction or a reverse direction; an expansion valve 18 arranged at a refrigerant pipe 16 connected between the outdoor heat exchangers 12 and the indoor units 20, for changing the refrigerant into a state of low temperature and low pressure; a compressor 22 for compressing the refrigerant to high temperature and high pressure; and an accumulator 24 connected to a suction side of the compressor 22, for dividing the refrigerant into gas and liquid to thusly supply the gaseous refrigerant to the compressor 22.

A blowing fan 26 for blowing the outdoor air for heat-exchanging toward the outdoor heat exchangers 12 is provided at one side of the outdoor heat exchanger 12. A bypass passage 34 having a check valve 32 is installed at a refrigerant pipe 16 at which the outdoor expansion valve 18 is installed.

The indoor units 20 respectively include an indoor heat exchanger 36 heat-exchanged with indoor air, and an indoor expansion valve 38 provided at one side of the indoor heat exchanger 36.

The distributor 30 includes: a high pressure pipe 40 connected to a discharge side of the compressor 22; first distributing pipes 44 diverged from the high pressure pipe 40 and connected to each of the indoor heat exchangers 36; a low pressure pipe 42 connected to a suction side of the compressor 22; second distributing pipes 46 diverged from the low pressure pipe 42 and connected to each of the indoor heat exchangers 36; and third distributing pipes 48 diverged from the refrigerant pipe 16 connected to the outdoor heat exchangers 12, and thus connected to each of the indoor heat exchangers 36.

First valves 50 for opening/closing the first distributing pipes 44 are installed at the first distributing pipes 44, and second valves 52 for opening/closing the second distributing pipes 46 are installed at the second distributing pipes 46.

A refrigerant exhauster for discharging a liquid refrigerant, which is accumulated in the high pressure pipe 40 toward the low pressure pipe 42 when the liquid refrigerant is accumulated in the high pressure pipe 40 at the time of a cooling operation, is installed between the high pressure pipe 40 and the low pressure pipe 42.

The refrigerant exhauster includes; a connection tube 60 connected between the high pressure pipe 40 and the low pressure pipe 42; an open and shut valve 62 provided at the connection tube 60, for opening/closing the connection tube 60; a capillary tube 64 installed at the connection tube 60, for expanding the liquid refrigerant within the high pressure pipe with a reduced pressure and thereafter discharging the refrigerant expanded with the reduced pressure to the low pressure pipe 42; a control unit for controlling the open and shut valve 62.

The open and shut valve 62 is preferably constructed as a solenoid type in which the connection tube is opened when power is applied thereto.

Figure 4:
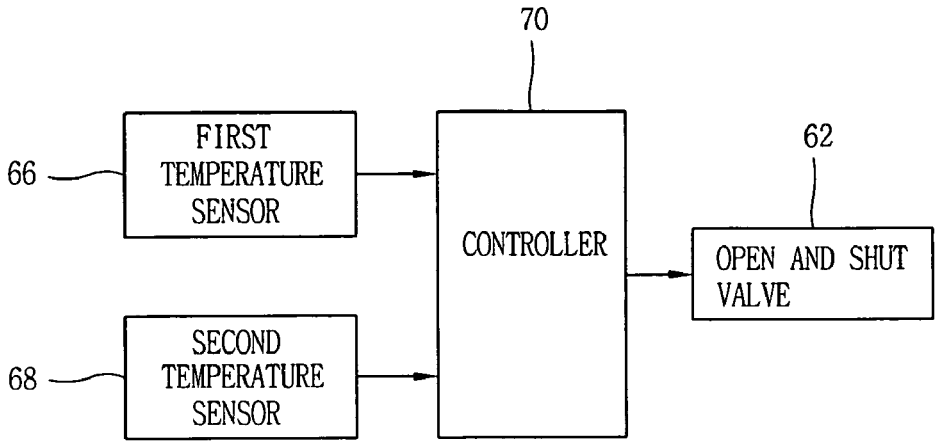
FIG. 4 is a block diagram showing a control unit of the multi type air-conditioner according to the present invention.

The control unit, as shown in FIG. 4, includes: a first temperature sensor 66 provided at the discharge side of the compressor 22, for detecting a temperature of the discharge side of the compressor 22; a second temperature sensor 68 provided at the high pressure pipe 40, for detecting a temperature of the high pressure pipe 40; and a controller 70 for comparing signals applied from both the first temperature sensor 66 and the second temperature sensor 68, and operating the open and shut valve 62 when it is decided that the temperature difference therebetween is more than a set valve.

An operation of a multi type air-conditioner according to the present invention having such construction will now be explained.

Figure 5:
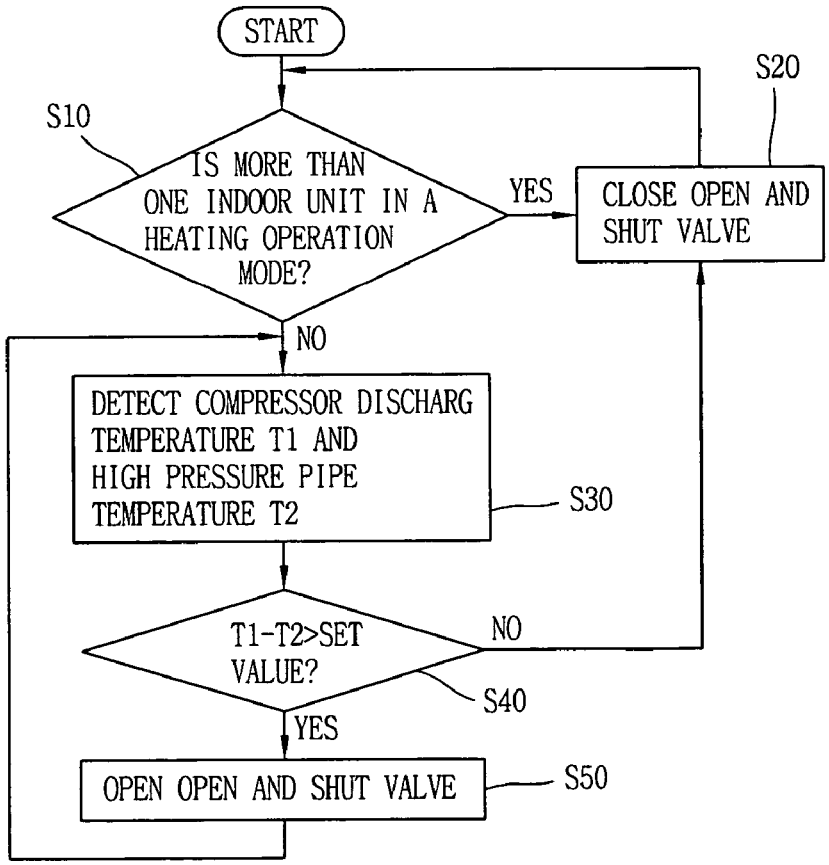
FIG. 5 is a flowchart showing sequential steps of a control method of a multi type air-conditioner according to the present invention.

FIG. 5 is a flowchart showing sequential steps of a control method of a multi type air-conditioner according to the present invention.

First, it is confirmed whether one or more indoor units in operation is in a heating operation mode (S10). If it is confirmed that one or more indoor units in operation is in the heating operation mode, power applied to the open and shut valve 62 is block to thusly close the connection tube 60 (S20).

Conversely, if it is confirmed that no indoor unit in operation is in the cooling operation mode, it is determined that all of the indoor units in operation perform the heating operation, and thereafter a discharge temperature T1 of the compressor 22 and a temperature T2 of the high pressure pipe 40 are detected (S30).

That is, the discharge temperature T1 of the compressor 22 is detected by the first temperature sensor 66 to be applied to the controller 70, and the temperature T2 of the high pressure pipe 40 is detected by the second temperature sensor 68 to be applied to the controller 70.

The controller 70 then compares the discharge temperature T1 of the compressor 22 and the temperature T2 of the high pressure pipe 40 and decides whether the temperature difference therebetween is more than a set value (S40).

If it is decided that the temperature difference therebetween is less than the set value, the controller 70 closes the open and shut valve 62 to maintain a state that the connection tube 60 is blocked. If it is decided that the temperature difference therebetween is more than the set value, the controller 70 decides it as a liquid refrigerant is accumulated in the high pressure pipe 40, so as to drive the open and shut valve 62 and thusly open the connection tube 60.

Afterwards, the liquid refrigerant accumulated in the high pressure pipe 40 is expanded with a reduced pressure while passing through the capillary tube 64 via the connection tube 60, and thereafter discharged to the low pressure pipe 42. The discharged liquid refrigerant joins a refrigerant flowing in the low pressure pipe 42 so as to be sucked into the compressor 22.

Figure 6:
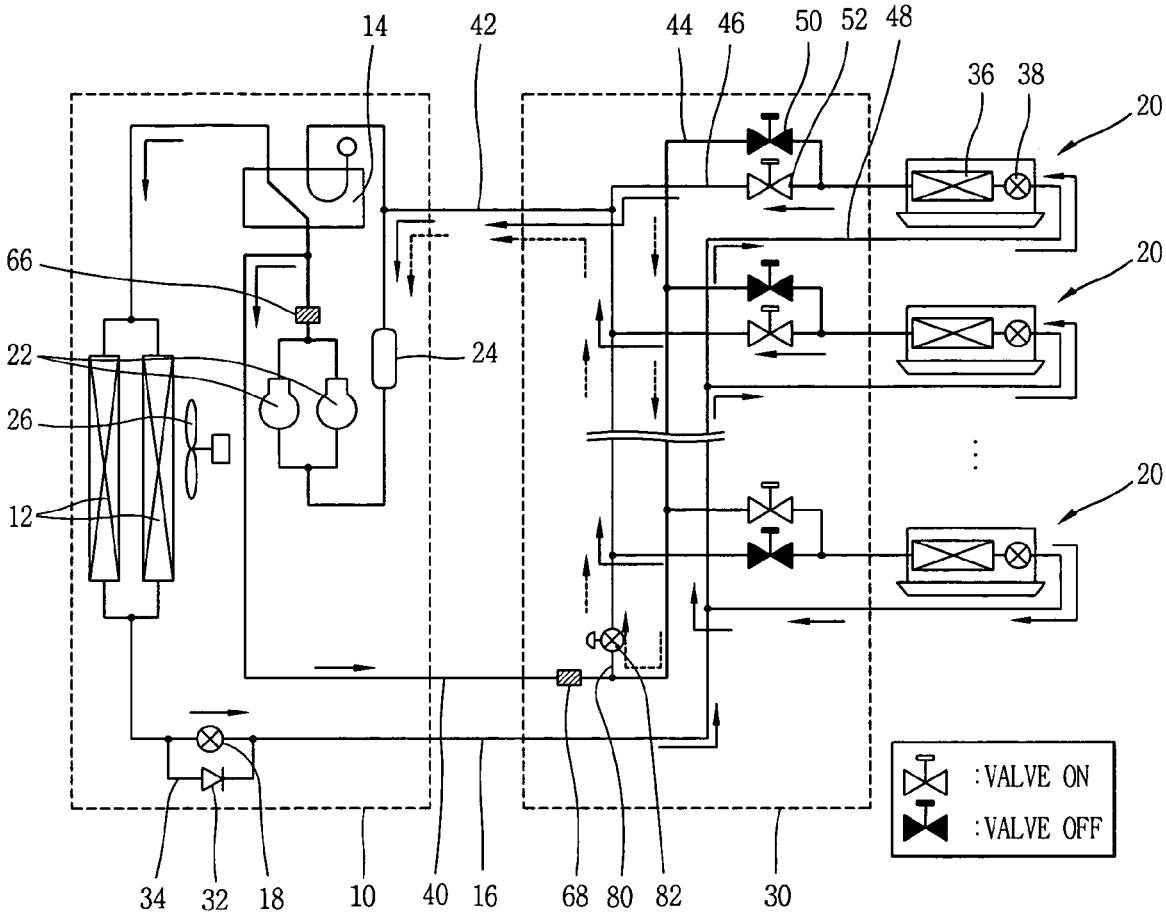
FIG. 6 is a diagram showing a construction of a multi type air-conditioner according to another embodiment of the present invention.

FIG. 6 is a diagram showing a construction of a multi type air-conditioner according to a second embodiment of the present invention.

An air-conditioner according to the second embodiment is the same as the air-conditioner having explained in the aforementioned embodiment, but is provided with a refrigerant exhauster having a different structure as that of the aforementioned embodiment.

That is, the refrigerant exhauster according to the second embodiment includes; a connection tube 80 connected between the high pressure pipe 40 and the low pressure pipe 42; an electric expansion valve 82 installed at the connection tube 80, for opening/closing the connection tube 80; and a control unit for controlling the electric expansion valve 82.

Here, the electric expansion valve 82 opens/closes the connection tube 80 and also expands the liquid refrigerant accumulated in the high pressure pipe 40 by lowering pressure while the liquid refrigerant passes therethrough.

The control unit is the same structure as that in the aforementioned embodiment. Also, an operation of the air-conditioner according to the second embodiment is the same as that of the air-conditioner having explained in the one embodiment, and accordingly an explanation therefor will be omitted.

As described above, in the multi type air-conditioner according to the present invention, the connection tube is connected between the high pressure pipe and the low pressure pipe and the open and shut valve is installed at the connection tube. Accordingly, when all of the indoor units in operation are in a cooling operation mode, if the liquid refrigerant is accumulated in the high pressure pipe, the open and shut valve is opened to thusly discharge the accumulated liquid refrigerant to the low pressure pipe. As a result, degradation of a cooling capability due to a lack of the refrigerant can be prevented by minimizing the amount of refrigerant accumulated in the high pressure pipe.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A multi type air-conditioner, comprising:

an outdoor unit having a plurality of outdoor heat exchangers that heat exchanges with outdoor air and a compressor that compresses a refrigerant;

a plurality of indoor units that performs either cooling or heating;

a high pressure pipe connected between a discharge side of the compressor and the plurality of indoor units;

a low pressure pipe connected between a suction side of the compressor and the plurality of indoor units; and a refrigerant exhauster provided between the high pressure pipe and the low pressure pipe, that discharges a liquid refrigerant to the low pressure pipe when the liquid refrigerant is accumulated in the high pressure pipe, wherein the refrigerant exhauster comprises:

a connection tube connected between the high pressure pipe and the low pressure pipe;

an open and shut valve installed on the connection tube, that opens and closes the connection tube;

a first temperature sensor installed on the discharge side of the compressor, that detects a temperature of the discharge side of the compressor;

a second temperature sensor installed on the high pressure pipe, that detects a temperature of the high pressure pipe;

a controller that controls the open and shut valve according to signals applied from the first temperature sensor and the second temperature sensor; and a capillary tube installed on the connection tube wherein the controller is configured to compare the discharge temperature of the compressor and the temperature of the high pressure pipe, decide whether a temperature difference therebetween is more than a set value, close the open and shut valve to maintain a state in which the connection tube is blocked when the temperature difference therebetween is less than the set value, and drive the open and shut valve so as to open the connection tube when the temperature difference therebetween is more than a set value.

2. The air-conditioner of claim 1, wherein the open and shut valve comprises a solenoid valve that opens the connection tube when power is applied thereto.

3. A control method of a multi type air conditioner having indoor units, a compressor, an open and shut valve comprising deciding whether all the indoor units in operation perform a cooling;

comparing a temperature of a discharge side of the compressor with a temperature of a high pressure pipe connected between the discharge side of the compressor and the indoor units when it is decided that all the indoor units perform the cooling;

turning the open and shut valve on to open a connection tube connected between the high pressure pipe and a low pressure pipe connected between a suction side of the compressor and the indoor units when it is decided that a temperature difference therebetween is more than a set value such that the liquid refrigerant of the high pressure pipe flows into the low pressure pipe; and turning the open and shut valve off when the temperature difference between the temperature of the discharge side of the compressor and the temperature of the high pressure pipe is less than the set value.

4. The method of claim 3, further comprising expanding the liquid refrigerant within the high pressure pipe by lowering pressure when the open and shut valve is turned on, and thereafter discharging the liquid refrigerant to the low pressure pipe.

5. The method of claim 3, wherein comparing the temperatures is implemented according to signals applied from a first temperature sensor, which detects the temperature of the discharge side of the compressor, and a second temperature sensor, which detects the temperature of the high pressure pipe.

* * * * *